US011454443B2

(12) United States Patent
Abdelraheem et al.

(10) Patent No.: US 11,454,443 B2
(45) Date of Patent: Sep. 27, 2022

(54) RF-HEATING IN INDUSTRIAL METALLIC CHAMBERS

(71) Applicant: Purdue Research Foundation, West Lafayette, IN (US)

(72) Inventors: Ahmed Mahmoud Mahrous Abdelraheem, West Lafayette, IN (US); Michael Dimitri Sinanis, West Lafayette, IN (US); Dimitrios Peroulis, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 549 days.

(21) Appl. No.: 16/587,151

(22) Filed: Sep. 30, 2019

(65) Prior Publication Data

US 2021/0041169 A1 Feb. 11, 2021

Related U.S. Application Data

(60) Provisional application No. 62/885,247, filed on Aug. 10, 2019.

(51) Int. Cl.
*F26B 3/347* (2006.01)
*H05B 6/78* (2006.01)
(Continued)

(52) U.S. Cl.
CPC ..... *F26B 3/347* (2013.01); *H05B 6/6447* (2013.01); *H05B 6/78* (2013.01); *H05B 6/806* (2013.01)

(58) Field of Classification Search
CPC ..... H05B 6/78; H05B 6/806; H05B 6/6447; F26B 3/347; H01J 37/32082;
(Continued)

(56) References Cited

U.S. PATENT DOCUMENTS 5,672,370 A 9/1997 Durance et al.
5,972,397 A 10/1999 Durance et al.
(Continued)

FOREIGN PATENT DOCUMENTS

WO WO-2021154077 A1 * 8/2021

OTHER PUBLICATIONS

L. R. Arnaut, "Operation of Electromagnetic Reverberation Chambers With Wave Diffractors at Relatively Low Frequencies," 2001, IEEE Trans. Electromagn. Compat., vol. 43, No. 4, pp. 637-653.
(Continued)

*Primary Examiner* — Abdullah A Riyami
*Assistant Examiner* — Syed M Kaiser
(74) *Attorney, Agent, or Firm* — Piroozi-IP, PLLC

(57) ABSTRACT

A method of uniform RF-heating within a chamber is disclosed, which includes cyclically varying electromagnetic properties of a chamber according to a plurality of configuration, transmitting an alternating RF signal about a first frequency range between a first frequency and a second frequency from a transmitter into the chamber, measuring electromagnetic power at a random receiver location in the chamber for each of the plurality of configurations and at a predetermined resolution of frequency thereby generating a statistical distribution vs. frequency, applying a statistical test to the generated statistical distribution based on a predetermined statistical function, determining a standard deviation of the average received power as a function of frequency, choosing a third frequency range associated with a standard deviation lower than a second threshold, and choosing an operational frequency in the third frequency range which provides maximum heating depending on the material being heated.

10 Claims, 9 Drawing Sheets

(51) Int. Cl.
*H05B 6/80* (2006.01)
*H05B 6/64* (2006.01)

(58) Field of Classification Search
CPC ..... H01J 37/32522; H01J 37/3266; H01J 37/32678; H01J 37/32743
See application file for complete search history.

(56) References Cited

U.S. PATENT DOCUMENTS

| | | | | |
|---|---|---|---|---|
| 8,653,482 | B2 * | 2/2014 | Ben-Shmuel | A23L 3/363 250/455.11 |
| 9,267,734 | B2 | 2/2016 | Durance et al. | |
| 2011/0154836 | A1 * | 6/2011 | Ben-Shmuel | H05B 6/6447 219/679 |
| 2012/0030963 | A1 | 2/2012 | Durance et al. | |
| 2017/0253414 | A1 * | 9/2017 | Linton | H05B 6/705 |
| 2018/0249855 | A1 * | 9/2018 | Carcano | H05B 6/686 |
| 2019/0059133 | A1 * | 2/2019 | Leindecker | G06N 20/00 |

OTHER PUBLICATIONS

J. M. Ladbury, G. H. Koepke, and D. G. Camell, "Evaluation of the NASA Langley Research Center Mode-Stirred Chamber Facility," 1999, Tech. Note (NIST TN)-1508, vol. 1508, No. Tech. Note (NIST TN)-1508.

D. A. Hill, "Plane Wave Integral Representation for Fields in Reverberation Chambers," 1998, IEEE Trans. Electromagn. Compat., vol. 40, No. 3, pp. 209-217.

C. L. Holloway, D. A. Hill, J. Ladbury, G. Koepke, and R. Garzia, "Shielding Effectiveness Measurements of Materials Using Nested Reverberation Chambers," May 2003, IEEE Trans. Electromagn. Compat., vol. 45, No. 2, pp. 350-356.

J. C. West, R. Bakore, and C. F. Bunting, "Statistics of the Current Induced Within a Partially Shielded Enclosure in a Reverberation Chamber," Dec. 2017, IEEE Trans. Electromagn. Compat., vol. 59, No. 6, pp. 2014-2022.

J. C. West, J. N. Dixon, N. Nourshamsi, D. K. Das, and C. F. Bunting, "Best Practices in Measuring the Quality Factor of a Reverberation Chamber," Jun. 2018, IEEE Trans. Electromagn. Compat., vol. 60, No. 3, pp. 564-571.

D. A. Hill, "Electronic Mode Stirring for Reverberation Chambers," 1994, IEEE Trans. Electromagn. Compat., vol. 36, No. 4, pp. 294-299.

C. L. Holloway, D. A. Hill, J. M. Ladbury, and G. Koepke, "Requirements for an Effective Reverberation Chamber: Unloaded or Loaded," Feb. 2006, IEEE Trans. Electromagn. Compat., vol. 48, No. 1, pp. 187-194.

H. Leaderman, "Eigenmodes and Composite Quality Factor of a Reverberating Chamber," 1957.

T. Matsuoka, S. Fujita, and S. Mae, "Effect of Temperature on Dielectric Properties of Ice in the Range 5-39 GHZ," 1996, J. Appl. Phys., vol. 80, No. 10, pp. 5884-5890.

S. M. Patel, T. Doen, and M. J. Pikal, "Determination of End Point of Primary Drying in Freeze-Drying Process Control," Mar. 2010, AAPS PharmSciTech, vol. 11, No. 1, pp. 73-84.

* cited by examiner

RF-HEATING IN INDUSTRIAL METALLIC CHAMBERS

CROSS-REFERENCE TO RELATED APPLICATIONS

The present patent application is related to and claims the priority benefit of U.S. Provisional Patent Application having Ser. No. 62/885,247, having the title "RF-HEATING IN INDUSTRIAL METALLIC CHAMBERS" filed Aug. 10, 2019, the contents of which are hereby incorporated by reference in its entirety into the present disclosure.

STATEMENT REGARDING GOVERNMENT FUNDING

This invention was not made with government funding.

TECHNICAL FIELD

The present disclosure generally relates controllable and uniform RF-Heating within a chamber.

BACKGROUND

This section introduces aspects that may help facilitate a better understanding of the disclosure. Accordingly, these statements are to be read in this light and are not to be understood as admissions about what is or is not prior art.

Uniform heating within a chamber is of high importance in many applications. One such application is lyophilization, which is generally known as freeze-drying. This process is widely used in both the pharmaceutical and food industries. This process involves controllably removing water content from a frozen solution. Lyophilization allows drugs or food products to be kept in a stable form for easier and longer storage. When the drug is required to be used, it can be easily rehydrated by adding water. Anti-cancer and anti-allergic drugs, attenuated vaccines, antibiotics, and probiotics are examples of such drugs that require lyophilization.

The typical operation of lyophilization includes loading lyophilizate (the drug solution being lyophilized) into vials. These vials are subsequently loaded into a freeze-drying chamber where they undergo the lyophilization.

The process of freeze drying can be divided into three main steps: freezing, primary drying and secondary drying. During primary drying, it is essential to keep the maximum product temperature below a critical temperature to avoid ruining the product. Therefore, uniform heating is necessary to ensure all the vials inside the chamber are receiving equal shares of heating energy and therefore having similar temperature versus time profiles.

The primary drying step is the most critical and time-consuming step. It is critical because the product can lose its efficacy and collapse if its temperature exceeded certain critical temperature during primary drying. On the other hand, it is time consuming because of the poor heat transfer mechanism in such drying processes. This in turn reduces the controllability on the heating process as the response time of changing temperature is exceedingly long.

As a result, there is an unmet need for a drying system and method that can uniformly distribute heat within a chamber and can provide abrupt turning ON/OFF the heat source to achieve better controllability.

SUMMARY

A method of uniform RF-Heating within a chamber is disclosed. The method includes a) cyclically varying electromagnetic properties of a chamber according to a plurality of configuration, wherein each configuration represents an electromagnetic instance/structure within the chamber, b) transmitting an alternating RF signal about a first frequency range between a first frequency and a second frequency from a transmitter into the chamber, c) measuring electromagnetic power at a random receiver location in the chamber for each of the plurality of configurations and at a predetermined resolution of frequency thereby generating a statistical distribution vs. frequency, d) applying a statistical test to the generated statistical distribution based on a predetermined statistical function; e) determining an acceptance ratio by comparing the generated statistical distribution to the predetermined statistical function as a function of frequency, f) identifying a lowest usable frequency (LUF) representing a frequency at which the acceptance ratio is higher than a first threshold, the LUF establishes a second frequency range between the LUF and the second frequency, g) moving the transmitter and receiver antennae with respect to one another and repeating steps a-c, thereby determining a standard deviation of the average received power as a function of frequency, h) choosing a third frequency range associated with a standard deviation lower than a second threshold; and i) choosing an operational frequency in the third frequency range which provides maximum heating depending on the material being heated.

DETAILED DESCRIPTION

Figure 1A:
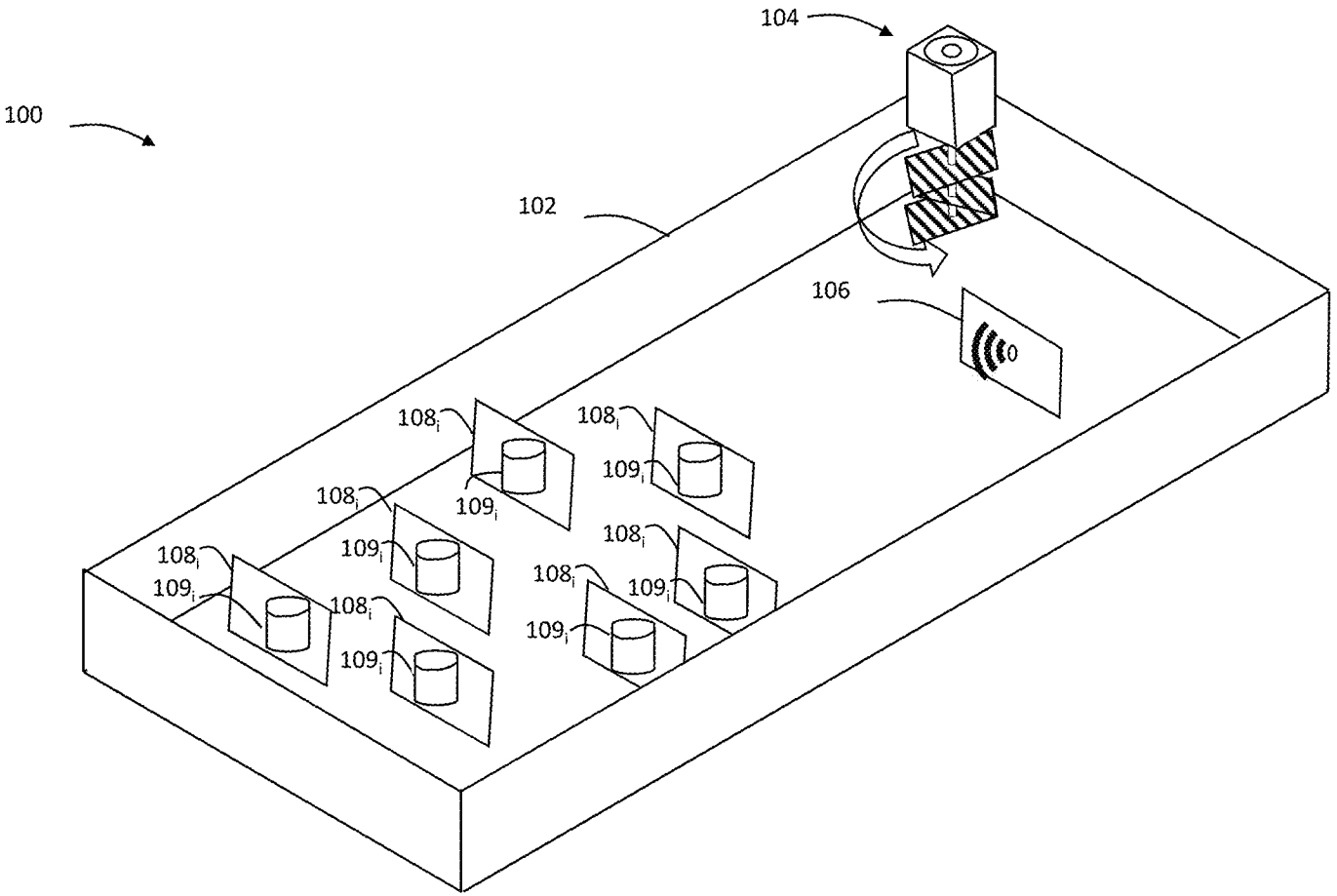
FIG. 1A is a schematic of an embodiment of a drying system, according to the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

In the present disclosure, the term "about" can allow for a degree of variability in a value or range, for example, within 10%, within 5%, or within 1% of a stated value or of a stated limit of a range.

In the present disclosure, the term "substantially" can allow for a degree of variability in a value or range, for example, within 90%, within 95%, or within 99% of a stated value or of a stated limit of a range.

A novel drying system and method that can provide uniform heat distribution at a large number of positions within a chamber and high controllability over the heat source is disclosed. The system is a radio frequency (RF)- based heating system. The method includes utilizing a statistical electromagnetism methodology in determining a power frequency from an alternating power source that can generate the desired uniform power distribution at these positions.

Referring to FIG. 1A, an example of an embodiment of such a novel drying system 100 according to the present disclosure is shown. In FIG. 1A, the system 100 includes a chamber 102 which according to an embodiment is a metallic Faraday chamber. Within the chamber 102 there exists a motor assembly 104, an alternating frequency power transmitter 106. While the motor assembly 104 including a motor 156, a stirrer 158 driven by a shaft 160 (see FIG. 1B) is shown inside the chamber 102, the motor 156 can be placed outside of the chamber 102 with the stirrer 158 placed inside the chamber 102. The stirrer 158 is shown as being positioned in one corner of the chamber 102, however, other positions are also within the scope of the present disclosure. Only one stirrer 158 is used in this embodiment, however, multiple stirrers are within the scope of the present disclosure. The purpose of the continuously rotating stirrer is to continuously change the electric and magnetic fields structures to thereby vary statistical electromagnetic environment inside the chamber. As discussed below, power is to be measured at different random positions $\mathbf{108}_i$ shown at a plurality of position. At each position $\mathbf{108}_i$, there may be a corresponding vial 109, which is desired to be heated. The dimensions of the chamber (e.g., 240 mm×550 mm×55 mm are for exemplary purposes only). In the chamber 102 afforded by such dimensions, power at different locations within the space are measured at such locations that will accommodate the vials to be placed and heated.

Figure 1B:
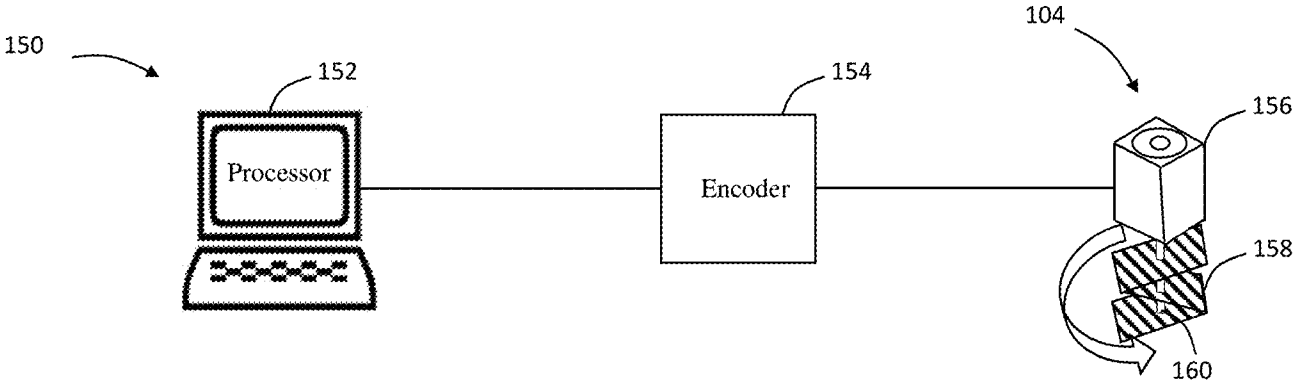
FIG. 1B is a schematic of a mechanical stirring system, according to the present disclosure.

According to another embodiment, the electric and magnetic fields structures within the chamber are continuously changed by electronic stirring, in which the frequency of the alternating transmitted power is continuously changed. For example, the frequency is continuously changed a predetermined bandwidth about a selected frequency $f_0$, as discussed further below. Referring to FIG. 1B, a mechanical stirring system 150 is shown whereby a processor 152 provides a signal to an encoder 154 which drives the motor 156. The motor 156 is coupled to the stirrer 158 via the shaft 160. Alternatively, the electric and magnetic fields are continuously changed by continuously changing amplitude of the applied alternating wireless power by a predetermined amplitude. In yet another approach, the frequency is changed electronically. In this embodiment, only mechanical stirring is utilized, however, a combination between mechanical stirring and electronic stirring is within the scope of this disclosure.

Figure 2:
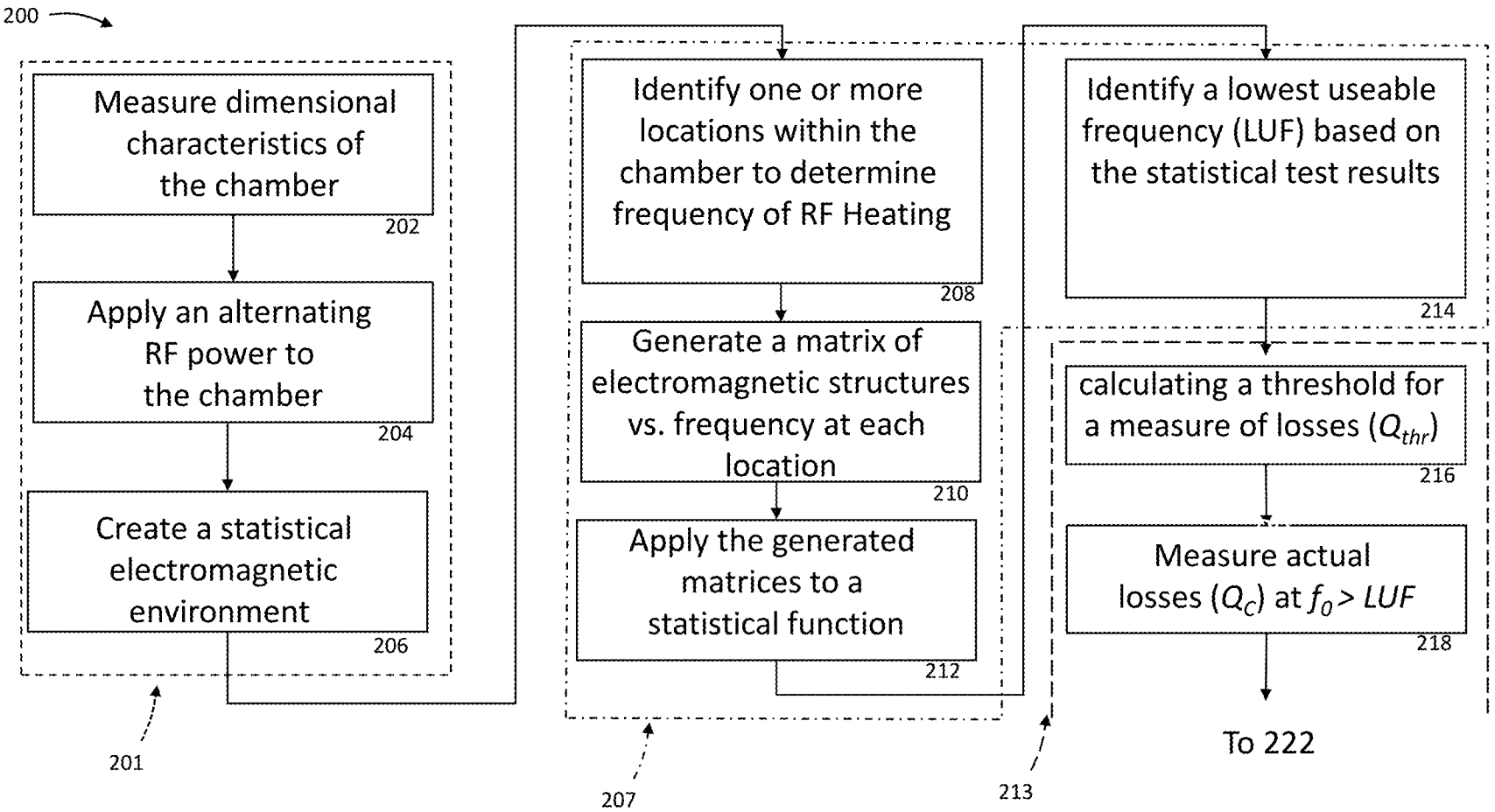
FIG. 2 provided over two pages is a flowchart of the steps of the present disclosure.
Figure 2:
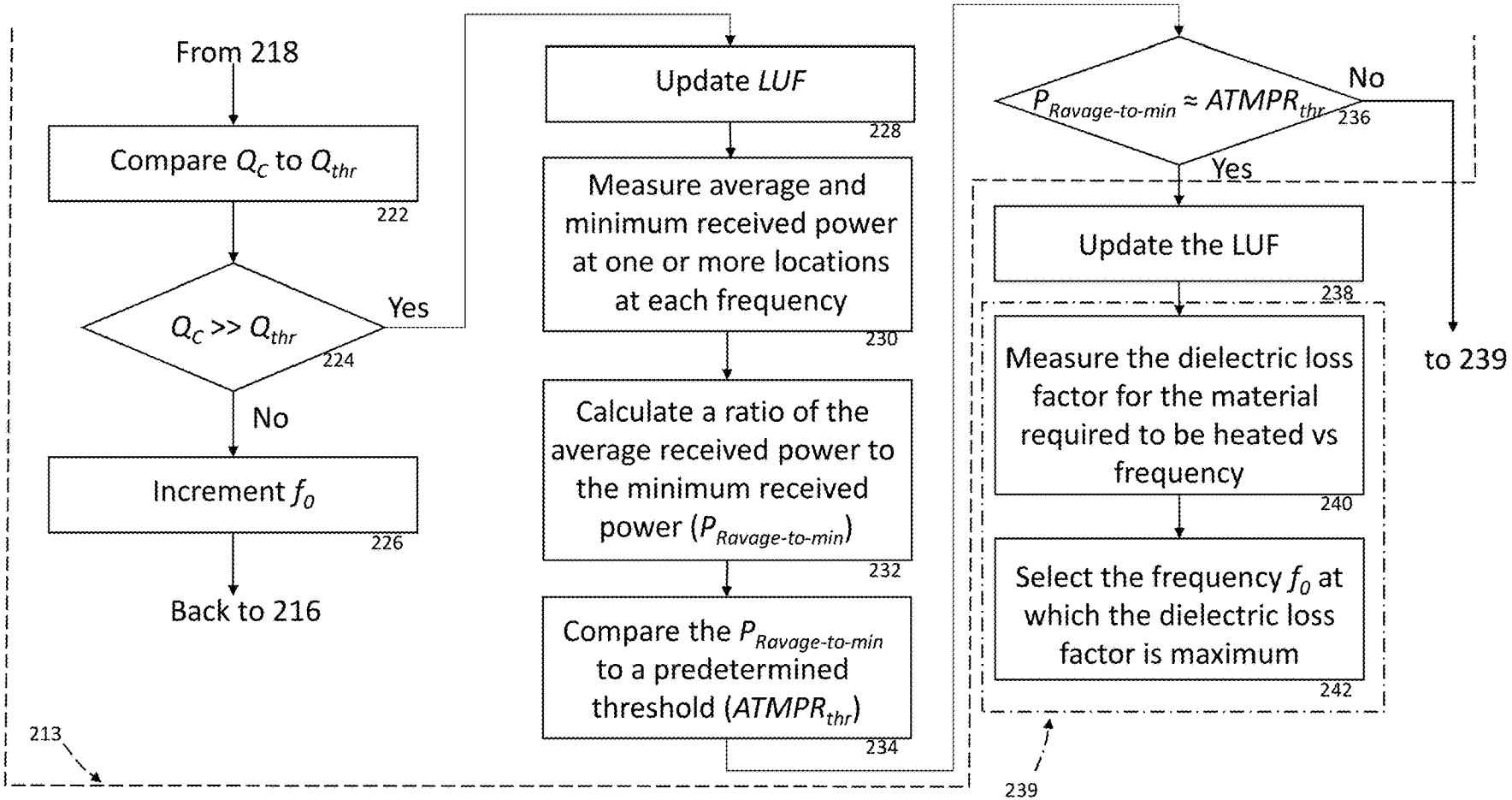

Referring to FIG. 2 (depicted on two pages) a flowchart of the basic steps of a method 200 according to the present disclosure are shown. The method 200 begins by generating a statistical electromagnetic environment 201. The step initially includes measuring dimensional characteristics of the chamber as provided in step block 202 in which uniform heating is desired. This step includes determining volume, surface area, largest dimension, and smallest dimension of the chamber. Next in block 204, an alternating power with frequency sweep within a preliminary frequency range is applied to the chamber such that one frequency is applied at a time. The alternating power is transmitted from the transmitter at a location within or outside of the chamber. The preliminary frequency range is determined based on the chamber size measurements. Next in block 206, a statistical electromagnetic environment is created within the chamber by continuously changing the electromagnetic structure. This can be done, by mechanical stirring, electronic stirring or a combination of both stirring mechanisms. For efficient stirring, and hence acceptable statistical electromagnetic performance, the frequency of the stirred waves has to fall within a range of frequencies that is determined using a frequency selection procedure discussed below. For efficient heating, a single frequency is then to be selected from this range based on the substance required to be heated. According to one embodiment, the electric and magnetic fields are continuously changed by mechanical stirring, in which a mechanical stirrer (see FIG. 1B) is continuously rotated inside the chamber. Therefore, collecting data at different stirrer orientations is equivalent to collecting data at different snapshots of the continuously varying electromagnetic structure. The data-sets are collected and thus are applied to the frequency selection procedure, discussed below, and then evaluated resulting in the statistical electromagnetic performance captured at several snapshots of the continuously varying electromagnetic structure. For example, the mechanical stirrer may be paused at 360 positions, thereby generating 360 snapshots of the continuously varying electromagnetic structure. Each snapshot is recorded within the preliminary frequency range. This entire data collection scheme is then repeated for several random positions within the chambers (see FIG. 1A, i.e., position $\mathbf{108}_i$).

With reference back to FIG. 2, once the electromagnetic environment has been established (step 201), then the method 200 proceeds to determining the lowest usable frequency (LUF) below which the statistical randomness of the electromagnetic environment falls below a predetermined threshold. This step is identified as the step 207 and is the first step in the frequency selection procedure. Step 207 includes block 208 which includes identifying one or more positions within the chamber. The received power is measured at each one of these positions as explained above. According to one embodiment, these locations correspond to locations of vials to be heated. Next in block 210, a matrix is generated based on the positions and the frequency of the alternating transmitted power. For example, suppose 10 locations have been randomly selected, the number of electromagnetic structures is 360 corresponding to the mechanical paddle having 360 discrete rotational positions, and each electromagnetic structure is recorded at 1000 frequencies. Then there will be 10 matrices for the 10 locations, each matrix will have 360 rows and 1000 columns, correspondingly. Next in block 212, the matrix is applied to a statistical function. In one example, the statistical function can be an exponential function. For example, the exponential function can be expressed as:

$$f_{\chi_2^2}(x)=(\tfrac{1}{2}\sigma^2)\exp(-x/2\sigma^2)U(x),$$

wherein $f_{\chi_2^2}$ is a Chi-Squared distribution function with two degrees of freedom, σ is the standard deviation of the parent normal distribution (any Chi-squared distribution is composed of the sum of squared 'n' normal distributions, where 'n' is the degree of freedom of the resulting Chi-Squared distribution—these normal distributions are referred to as parent normal distribution), and x is the received power.

Figure 3A:
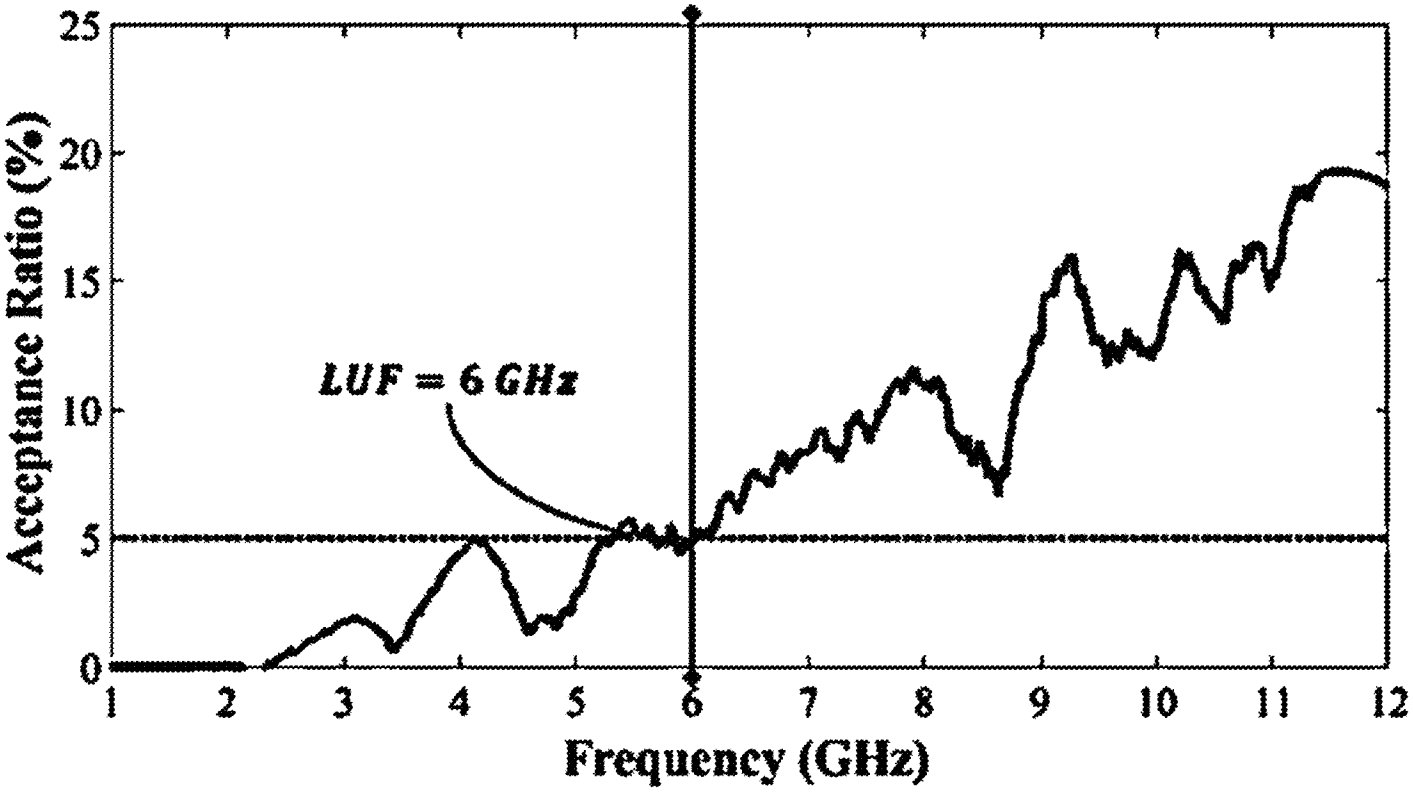
FIG. 3A is a graph of acceptance ration (a statistical measure) vs. frequency in GHz.

Upon application of the above-described matrix to the statistical function, a graph is thus generated describing acceptance ratio percentage (which is a measure of fit quality of the statistical function) vs. frequency. An example of this graph is shown in FIG. 3A. Determining where the graph crosses a predetermined threshold for acceptance ratio % (in the graph of FIG. 3A, this threshold was equated to 5%), a lowest usable frequency (LUF) is thus identified. In FIG. 3A, the LUF is about 6 GHz. This step is shown in Block 214.

Once the LUF is chosen, the method 200 evaluates the created statistical electromagnetic environment according to the step 213 by measuring the chamber quality factor and average-to-minimum received power at all frequencies higher than or equal to the measured LUF. As a result, LUF can be updated in a recursive manner. Generally, higher frequencies yield better statistical properties. At the LUF, there is enough electromagnetic modes (i.e., simultaneously coexisting and superimposed electromagnetic structures) in the chamber to generate a statistical electromagnetic environment. However, using the LUF is not necessarily sufficient for creating an acceptable statistical electromagnetic environment. The range of frequencies (greater than LUF) valid for this purpose should be determined. An example of these tests are the chamber quality factor test and the average-to-minimum received power test.

The step 213 includes block 216 which calculates a threshold for a measure of losses ($Q_{thr}$) around LUF is determined. The $Q_{thr}$ is calculated based on:

$$Q_{thr} = \left(\frac{4\pi}{3}\right)^{\frac{2}{3}} \frac{3V^{\frac{1}{3}}}{2\lambda},$$

wherein V is the volume of the chamber, and $\lambda$ is wavelength of the alternating power, where $\lambda$ is calculated based on:

$\lambda = c_0/f$, where $c_0$ is the speed of light.

Figure 4:
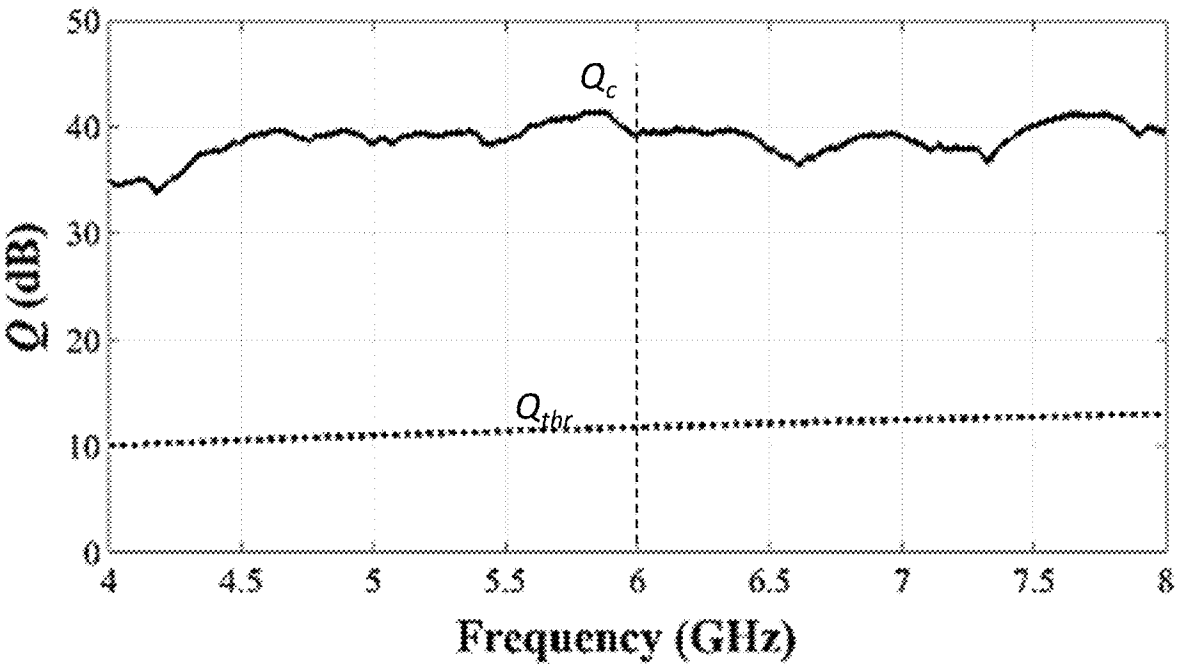
FIG. 4 is a graph of losses vs. frequency in GHz.

Next in block 218, actual losses ($Q_c$) of the chamber is measured at frequency $f_0$ (the initial value for $f_0$ is the LUF). The losses are the result of i) Joules-heat owing to imperfect conductive walls generating currents that turn into heat, or ii) dielectric losses which also turn into losses generating heat. The losses in the chamber $Q_c$ is determined according to one embodiment by i) measuring a power delay profile (PDP) at a frequency $f_0$; ii) plotting the PDP on a dB scale; iii) fitting the PDP curve to a linear function; iv) determining slope of the linear function forming a time constant ($\tau_1$) of the chamber at the frequency $f_0$; v) calculating $Q_c$ as $2\pi f_0 \tau_1$; and vi) repeating steps (i) through (v) for different frequencies $f_0$. A graph of $Q_{thr}$ and $Q_c$ is shown in FIG. 4. At 6 GHz the measured $Q_c$ is about 40 dB. Next in block 222, $Q_{thr}$ and $Q_c$ are compared. In decision block 224, if $Q_c >> Q_{thr}$ then the method 200 proceeds updating the LUF in block 228, otherwise, the method 200 increments $f_0$ and returns to block 216 (where the newly incremented frequency $f_0$ is used to calculate $Q_{thr}$).

If the $Q_c >> Q_{thr}$ then after updating LUF the method 200 proceeds to measuring the average and minimum power at the plurality of positions for frequencies greater than or equal to LUF. Once the average and minimum power are measured, next in block 232, the method 200 proceeds to calculating the ratio of the average received power to the minimum received power ($P_{Ravage\text{-}to\text{-}min}$). Next in block 234, the method 200 compares the calculated $P_{Ravage\text{-}to\text{-}min}$ to a predetermined average to minimum power ratio ($ATMPR_{thr}$), where $ATMPR_{thr}$ is calculated based on:

$$ATMPR_{thr}\,[dB] = 10 \log_{10}(N) + 2.5,$$

where

Figure 5:
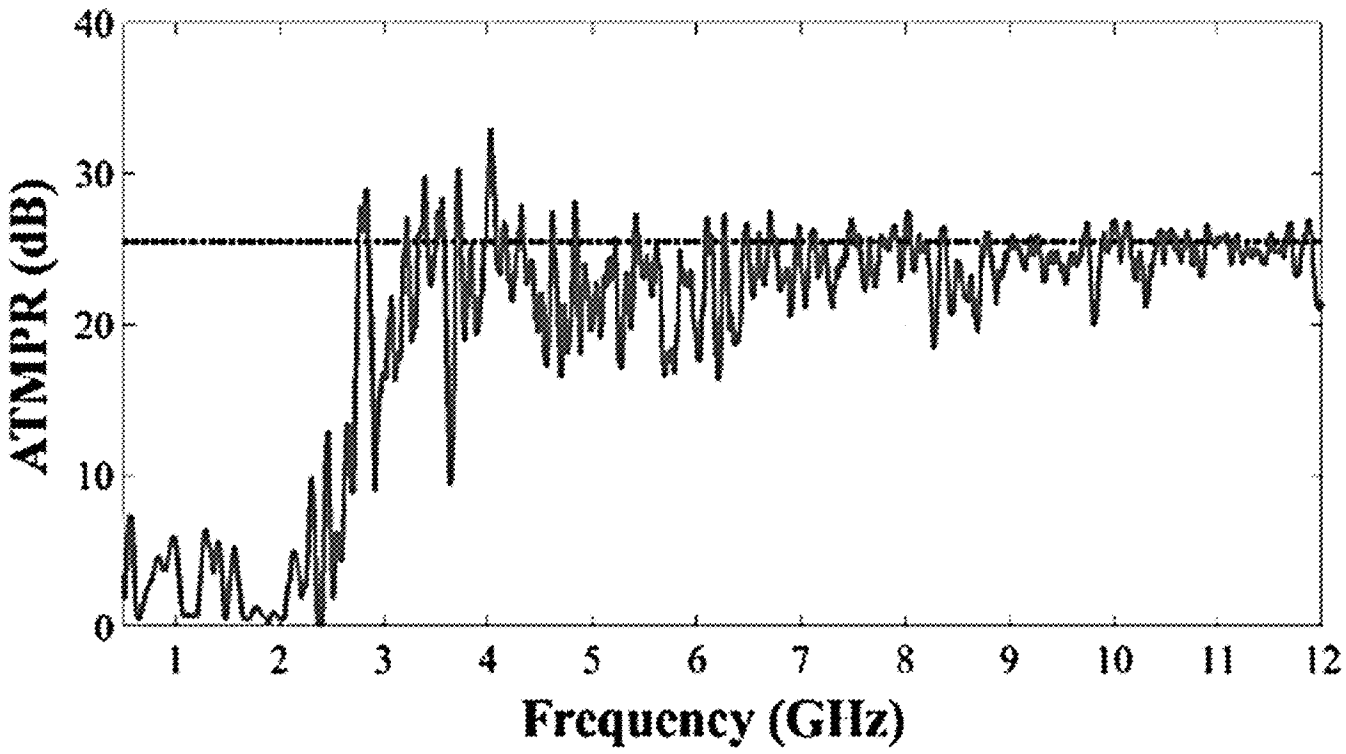
FIG. 5 is a graph of average to minimum power ratio vs. frequency in GHz.

N is the number of stirring points used while collecting data-sets. In this embodiment, N refers to the number of stirrer steps (e.g., 360 as in the example provided above with respect to the number of positions of the mechanical stirrer). An Example of a graph comparing actual power measurements expressed as $P_{Ravage\text{-}to\text{-}min}$ to $ATMPR_{thr}$ is shown in FIG. 5. The measured ATMPR swings about the predetermined $ATMPR_{thr}$ as discussed above. Smaller swing about this value implies better statistical properties. Next in the decision block 236, $P_{Ravage\text{-}to\text{-}min}$ is compared to $ATMPR_{thr}$. If the minimum frequency at which the swing of $P_{Ravage\text{-}to\text{-}min}$ about $ATMPR_{thr}$ is acceptable is higher than the LUF, then the LUF is updated to the new value in block 238. Otherwise, the method proceeds to block 239.

Finally, in step 239 the method 200 measures the dielectric loss of the material required to be lyophilized at all the selected frequencies (including block 240). Next, in block 240 the method 200 selects the frequency at which this dielectric loss is maximum (block 242).

A system comprising more than a general purpose computer can be used to assemble the data for the above-described steps. According to one embodiment, this system may contain i) a sampling prob to measure the field anywhere within the chamber; ii) an amplifier to control the input power; iii) a signal generator to generate the desired frequency and to vary the driving frequency (in case electronic stirring by changing frequency is employed); iv) a noise generator to change the driving signal amplitude (in case electronic stirring by changing amplitude is employed); v) a paddle with rotation mechanism (in case mechanical stirring is employed); and a code implementation for the postprocessing of the data-sets.

To facilitate understanding of the system and method of the present disclosure, the following exemplary non-limiting description is provided. As discussed above, the present disclosure is directed to applying the method of RF-heating based on statistical electromagnetics for the purpose of lyophilization. Lyophilization, or freeze-drying, is the process of extracting the water content of a substance by the following steps:

1—Freezing, during which the vials filled with the substance under lyophilization are frozen down to very low temperatures (e.g., −40° C. to −60° C.)

2—Primary drying, during which the chamber enclosing these vials is vacuumed (typically 50 to 150 mtorr). This phase, consequently, brings down the boiling temperature of the substance such that when heat energy is provided, the water content sublimates leaving a dried substance behind.

3—Secondary drying, during which the vacuum is released and heat energy is continued to be supplied to release any remaining traces of water in the dried substance.

Lyophilization is widely used in the pharmaceutical and biological industries. In its current form, the necessary heat energy required for primary drying is provided through heating shelves. This, in turn, results in a non-uniform and extremely slow process. This non-uniformity could result in unevenly dried vials, which cannot be tolerated in pharmaceutical and biological industries.

During the primary drying phase, the following exemplary and non-limiting steps are performed according to the present disclosure:

Step 1—A chamber is established for the sake of electromagnetic measurements.

Step 2—A statistical electromagnetic environment is created inside the chamber using mechanical stirring.

Step 3—An initial frequency selection procedure is followed.

Step 4—Statistical uniformity is verified as a secondary frequency selection procedure.

Step 5—A final frequency selection procedure is followed.

Each of these steps is now discussed in greater detail.

1—Establishing the Chamber

In this step, an auxiliary customized chamber is created to provide the freedom of conducting measurements outside the lyophilizer. It should be mentioned that the customized chamber can be free of a base so that the chamber can be placed inside an industrial lyophilization chamber whereby vials of interest can simply be placed on the shelves of the industrial lyophilization chamber. For the measurements conducted outside the industrial lyophilization chamber, a stainless-steel panel can be used as a base for the baseless customized chamber. It should also be noted that if electronics can be shielded and protected then no auxiliary chamber is needed. The auxiliary (secondary) chamber can also be used to study the electromagnetic environment, e.g., for experimentation.

According to one embodiment, the mechanical stirring can be replaced with electronic stirring. This replacement may be due to too small size of chamber, and thus no room for mechanical stirrers. An electronic stirrer may be configured to provide perturbations around center frequency ($\pm\Delta f$ around center frequency) or perturbation of amplitude. ($\pm\Delta A$), thus in each case changing the transmitter signals, accordingly.

The first order of importance is the establishment of the statistical electromagnetic chamber, whether a chamber generated outside the actual lyophilization chamber and placed inside or the actual lyophilization chamber itself. The objective from generating a random (statistical) electromagnetic environment is to achieve electromagnetic statistical uniformity inside the chamber. In other words, the electromagnetic power at a random location inside the chamber will be statistically uniform to a known (and user-defined) standard deviation. The basic idea to create a random (statistical) electromagnetic environment is to continuously change the electromagnetic boundary conditions inside the chamber. There are two basic approaches to do this:

1—Mechanical Stirring

2—Electronic Stirring

Both of these approaches are within the scope of the present disclosure. In the case of mechanical stirring (shown in the figures of the present disclosure), a geometrically irregular and electrically large (relative to the range of frequencies of interest) metallic stirrer(s) is(are) continuously rotated inside the chamber. Examples of the shapes and positions in the chamber of the stirrers utilized are shown in FIGS. 1A and 1B. One or more of such stirrers can be utilized, although only one is shown. One or more stepper motors controlled by a computer code are utilized to controllably rotate the stirrers.

As discussed above, the next step is the initial frequency selection. The objective from the initial frequency selection procedure is to measure the minimum frequency below which the statistical properties of the created random electromagnetic environment are compromised. This frequency is called the lowest usable frequency (LUF), it depends mainly on the geometrical properties of the chamber (Step 1, enumerated above), and the approach adopted for creating the random electromagnetic environment (Step 2, enumerated above). Therefore, the final frequency selected for RF-Heating in a given chamber should be larger than the LUF measured for this chamber.

The theory of statistical electromagnetic predicts that the received power in a random electromagnetic environment follows an exponential distribution. The idea to measure the LUF, is to collect a large sample of received power measurements at each frequency in a preliminary range of frequencies estimated based on the chamber size. Then, a statistical test is performed on each sample to determine whether this sample was drawn from an exponential population or not. The minimum frequency that passes the test is the LUF of the chamber.

Practically, to measure the LUF, a receiving antenna (Rx ANT), connected to a power-meter, is used to collect a large sample of the received power. The procedure is as follows:

Step (i) The Rx ANT is mounted at a random location.

Step (ii) The received power is measured versus frequency at a large number of different orientations of the stirrer(s) in Step-i. In one exemplary embodiment, two stirrers are used (only one is shown in FIG. 1A). Although these stirrers are meant to continuously rotate in the final design, for the sake of measurements, they were step-rotated such that the first stirrer makes a first plurality of steps (e.g., 200 steps) to complete one rotation and the second stirrer makes a second plurality of steps (e.g., 20 steps) to complete one rotation. This results in a multiplication of the numbers associated with the first and second pluralities (in this example, 4000) of different relative orientations to both stirrers. At each orientation, the received power is recorded in the preliminary frequency range from a first frequency (e.g., 10 MHz) to a second frequency (e.g., 25 GHz) based on a predetermined resolution (e.g., 20001 frequency points in this range). The predetermined resolution is based on capability of the measurement equipment.

Step (iii) At this point, we have a sample of 4000 measurements of the received power at each frequency. A statistical test is performed on each sample. Statistical tests are known to a person having ordinary skill in the art. The statistical test is based on a predetermined distribution function. For example, an Anderson Darling test is a test for prediction of whether power is distributed according to an exponential function. The test results are in the form of acceptance ratio. Acceptance ratio provides a measure of deviation, otherwise known as significance level from the expected distribution function (in this case an exponential distribution function). For example the significance level can establish a threshold of 5%. At each frequency, if the acceptance ratio is larger than 5% (the conventional significance level for the Anderson Darling test), then the sample passes the test. The results of this test are depicted in FIG. 3. Only frequencies up to 12 GHz are shown because higher frequencies passes the test, regardless. From the figure, it is clear that the LUF for the given chamber is about 6 GHz. At this stage, the process has narrowed the range of frequency from the first a second frequencies (10 MHz-25 GHz) to a smaller range (6 GHz-25 GHz).

Figure 3B:
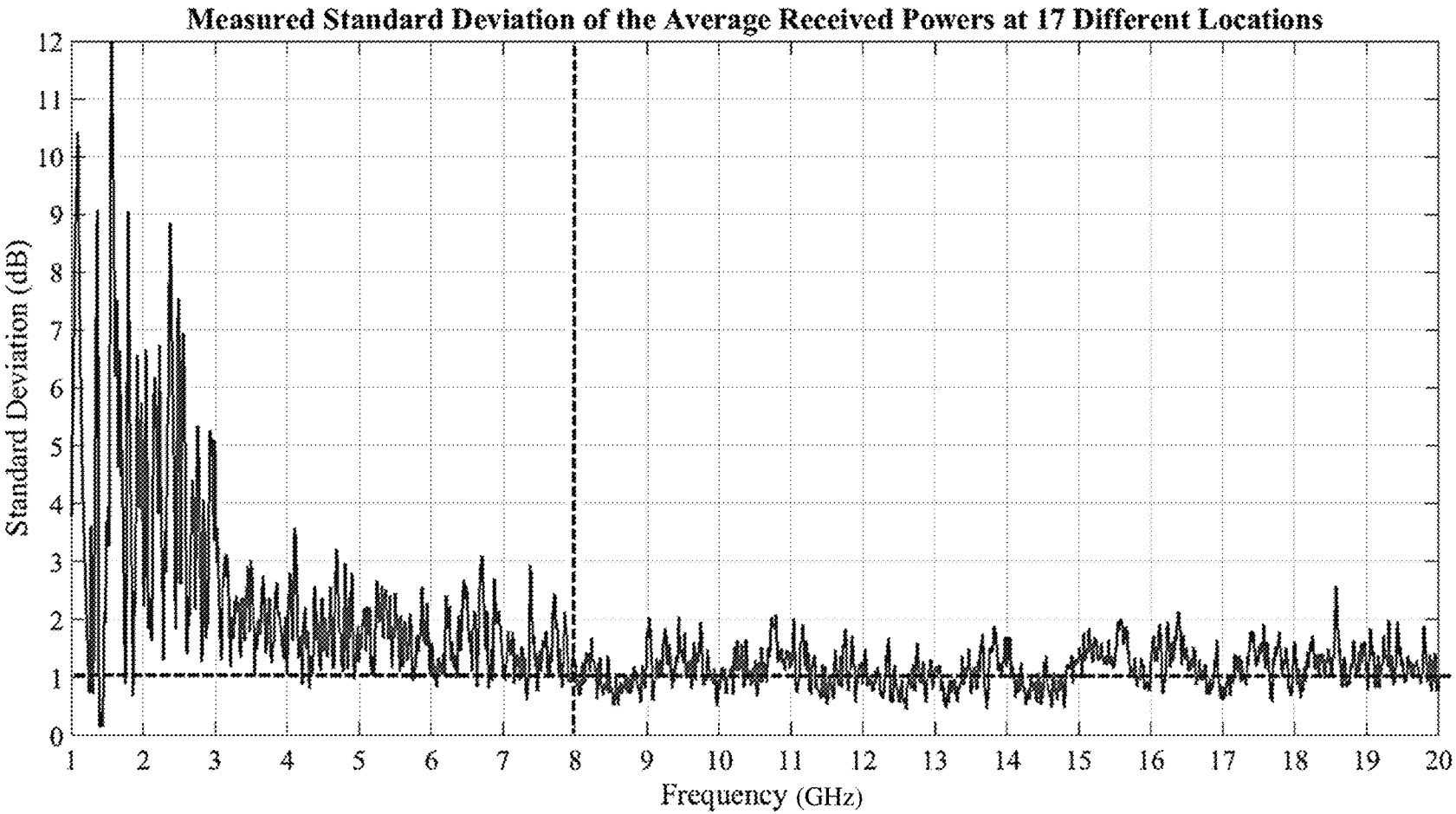
FIG. 3B is a graph of measured standard deviation of power vs. frequency in GHz.

Being the objective of generating a statistical electromagnetic environment, it is essential to verify uniformity before proceeding. To verify uniformity, again the Rx ANT, connected to power meter, is utilized. The idea is to measure the standard deviation of the measured average received power versus frequency at different locations inside the chamber. Here we are averaging the power measurements (e.g., 4000 points) at one location of the transmitter and then repeat same procedure and then move the transmitter-receiver antennas with respect to one another to a plurality of other positions and make the same measurements. According to one embodiment, the number of measurements can be between 10-50, or between 15-25, or about 17. From these measurements, a standard deviation can be measured (in dB) vs. frequency. This graph is shown in FIG. 3B. As can be seen from FIG. 3B, the standard deviation drops as frequency increases. Choosing a predetermined standard deviation threshold, e.g., 1 dB, the corresponding frequency choice is further refined. The theory of statistical electromagnetics predicts a standard deviation in the average received power of 1 dB to be maintained at all frequencies higher than or equal to the LUF. However, since the created statistical electromagnetic environment is not ideal, the 1 dB standard deviation can be achieved at a frequency higher than the LUF. This means that the frequency of operation is further narrowed to between 8 GHz and 25 GHz.

The objective from the secondary frequency selection procedure is to measure the standard deviation of a large sample of average received powers at different locations and select the minimum frequency above which the standard deviation (and hence uniformity) is acceptable. The procedure is as follows:

Step (I) Same as Step (i)

Step (II) Same as Step (ii)

Step (III) AT each frequency, the received powers collected at different stirrers orientations are averaged resulting in an array of average powers versus frequency at the given location of the Rx ANT.

Step (IV) The Rx ANT is moved to a new location and the procedure from (i) to (iii) is repeated. In the given example, this was repeated at 17 different locations.

Step (V) At this point, we have a sample of 17 average received power measurements at each frequency point. For each sample, the standard deviation is calculated. These results are plotted in FIG. 05. It is clear from the figure that the standard deviation is maintaining a uniform swing about 1 dB after 8 GHz.

From the previous procedure, the selected frequency for RF-heating in the given chamber should be higher than 8 GHz for statistically uniform power distribution within 1 dB of standard deviation.

The final frequency selection objective is to select a frequency from the range of frequencies determined by the secondary frequency selection in Steps (I)-(V). This final frequency selection is application dependent, meaning it is controlled by the purpose of heating or the material to be heated.

The equation below provides a solution the electromagnetic power dissipated as heat in a dielectric material upon exposure to electromagnetic waves:

$$P_d = 2\pi f \epsilon_0 \epsilon_r(f) |E|^2$$

where $P_d$ is the power dissipated as heat, f is the frequency of the applied electromagnetic wave, $\epsilon_0$ is the permittivity of free-space,

|E| the electric field amplitude of the applied electromagnetic wave, and $\Sigma_r(f)$ is the dielectric loss (also referred to as relative permittivity) of the dielectric material being heated. The dielectric loss is function of frequency. Therefore, the dielectric loss should be measured in the frequency range determined in Step (I)-(V). Then, the frequency at which this dielectric loss is maximum should be selected as the final frequency for RF-heating.

After applying the aforementioned procedure and conducting all the necessary dry measurements, the generated chamber is inserted in the LyoStar3 lab-scale lyophilizer. A conventional (without RF) freeze-drying process is initially conducted to be used as a reference for the enhancement achieved by the system and method of the present disclosure. There are two enhancements targeted:

(A) Accelerated process, and (B) More Uniform process.

The uniformity of the applied electromagnetic power has been shown based on Steps (I)-(V). The acceleration achieved by using the RF-assisted heating instead of the conventional heating provided by the lyophilizer shelf is also realized. Particularly, the acceleration of the primary drying step of lyophilization is of interest. To be able to measure this acceleration, the end of drying time must be first established.

Figure 6:
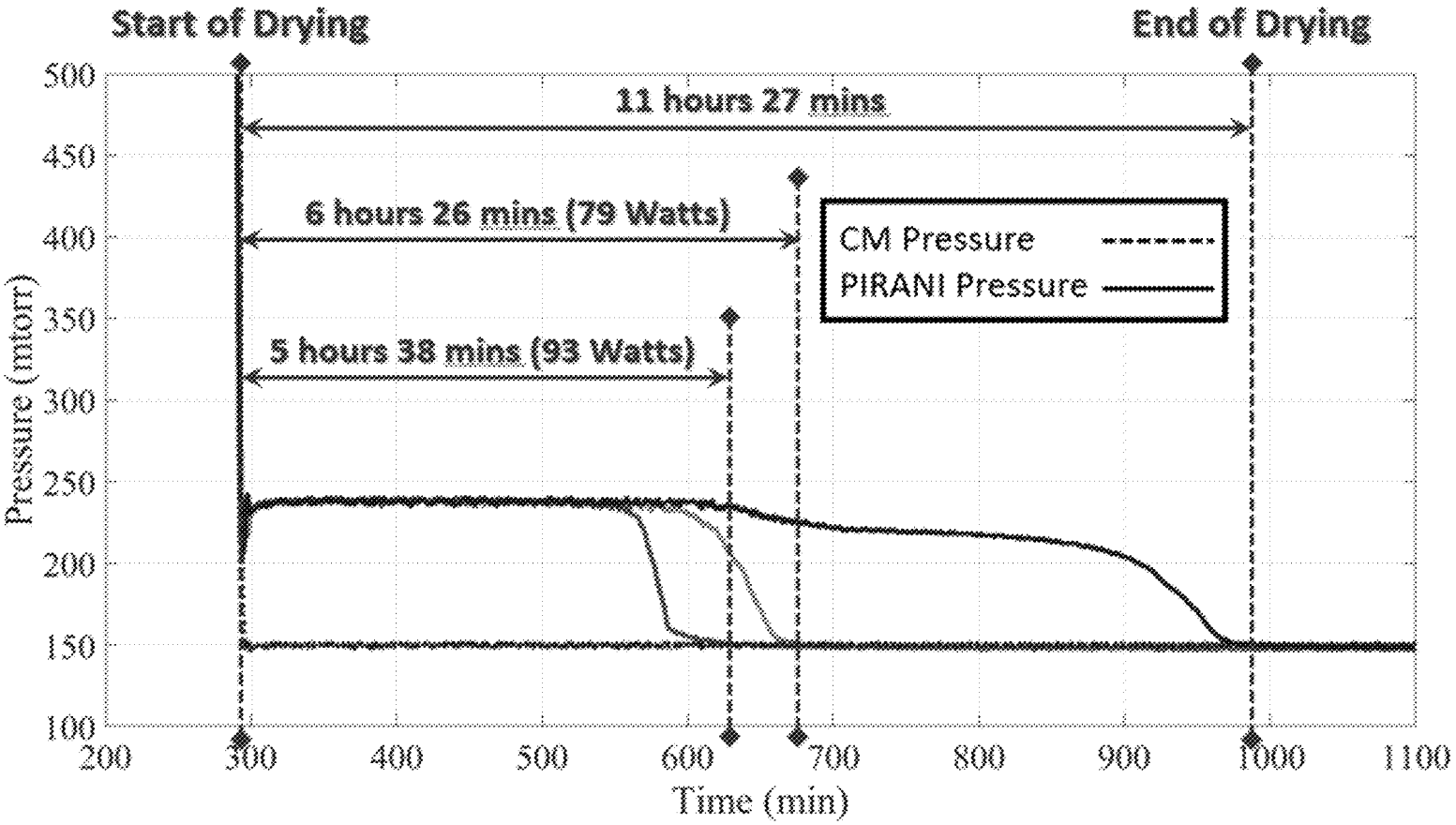
FIG. 6 is a Pirani and capacitance monometer (CM) pressures versus time for the conventional freeze-drying process and two RF-assisted freeze-drying processes of the present disclosure.

During lyophilization, two gauges, the CM gauge and the Pirani gauge continuously measure the lyophilizer chamber pressure. The Pirani pressure is usually higher than the CM pressure as it includes the pressure introduced by the released vapors during primary drying. Towards the end of drying, these vapors start to diminish and the Pirani pressure converges to the CM pressure. The end of drying is defined as the time at which this convergence takes place. Given that explanation, FIG. 6 is a plot of the Pirani and CM pressures versus time for the conventional freeze-drying process and two RF-assisted freeze-drying processes, one with 79 watts of RF power and the other with 93 watts of power. It is clear, that with a relatively low RF power (compared to the power used in commercial microwaves; 1000:1500 watts), the primary drying time is reduced by about 50%. A visual inspection of the dried vials indicate complete dryness without any of the side-effects of improper drying such as collapse or unacceptable shrinkage.

Those having ordinary skill in the art will recognize that numerous modifications can be made to the specific implementations described above. The implementations should not be limited to the particular limitations described. Other implementations may be possible.

The invention claimed is:

1. A method of uniform RF-Heating within a chamber, comprising:

a. cyclically varying electromagnetic properties of a chamber according to a plurality of configuration, wherein each configuration represents an electromagnetic instance/structure within the chamber;

b. transmitting an alternating RF signal about a first frequency range between a first frequency and a second frequency from a transmitter into the chamber;

c. measuring electromagnetic power at a random receiver location in the chamber for each of the plurality of configurations and at a predetermined resolution of frequency thereby generating a statistical distribution vs. frequency;

d. applying a statistical test to the generated statistical distribution based on a predetermined statistical function;

e. determining an acceptance ratio by comparing the generated statistical distribution to the predetermined statistical function as a function of frequency;

f. identifying a lowest usable frequency (LUF) representing a frequency at which the acceptance ratio is higher than a first threshold, the LUF establishes a second frequency range between the LUF and the second frequency;

g. moving the transmitter and receiver antennae with respect to one another and repeating steps a-c, thereby determining a standard deviation of the average received power as a function of frequency;

h. choosing a third frequency range associated with a standard deviation lower than a second threshold; and i. choosing an operational frequency in the third frequency range which provides maximum heating depending on the material being heated.

2. The method of claim 1, wherein the predetermined statistical function is selected from the group consisting of exponential and chi-squared distribution functions.

3. The method of claim 2, the statistical test is an Anderson Darling test.

4. The method of claim 3, the operational frequency is determined by determining at which frequency in the third frequency range the dielectric loss is maximum.

5. The method of claim 1, the cyclically variation of the electromagnetic environment is achieved by mechanical stirring.

6. The method of claim 5, the mechanical stirring includes one or more paddles that are rotating about a shaft.

7. The method of claim 5, the mechanical stirring includes two mechanical stirrers.

8. The method of claim 1, the cyclically variation of the electromagnetic environment is achieved by at electronic stirring.

9. The method of claim 8, the electronic stirring is caused by frequency variation.

10. The method of claim 8, the electronic stirring is caused by amplitude variation.

* * * * *